United States Patent [19]

Domingorena

[11] 4,263,787

[45] Apr. 28, 1981

[54] EXPANSION DEVICE WITH ADJUSTABLE REFRIGERANT THROTTLING

[75] Inventor: Albert A. Domingorena, Liverpool, N.Y.

[73] Assignee: Carrier Corporation, Syracuse, N.Y.

[21] Appl. No.: 98,590

[22] Filed: Nov. 29, 1979

[51] Int. Cl.[3] ..... F25B 13/00

[52] U.S. Cl. ..... 62/324.6; 62/528; 137/513.3; 138/45; 251/121

[58] Field of Search ..... 62/511, 527, 528, 324; 137/513.3; 251/121; 138/45

[56] References Cited

U.S. PATENT DOCUMENTS

| | | | |
|---|---|---|---|
| 3,482,415 | 12/1969 | Trask | 251/121 |
| 3,642,030 | 2/1972 | Amick | 62/511 |
| 3,877,248 | 4/1975 | Honnold, Jr. | 62/511 |
| 3,992,898 | 11/1976 | Duell et al. | 62/527 |
| 4,114,397 | 9/1978 | Takahashi et al. | 62/528 |

*Primary Examiner*—Ronald C. Capossela

*Attorney, Agent, or Firm*—J. Raymond Curtin; Robert P. Hayter

[57] ABSTRACT

An expansion device having a piston sliding between first and second positions within a valve body. In the first position the piston meters refrigerant flow therethrough and in the second position the piston allows refrigerant to flow unrestricted through the device. Means are disclosed for adjusting the throttling of the refrigerant through the device when it is acting as an expansion device.

10 Claims, 3 Drawing Figures

EXPANSION DEVICE WITH ADJUSTABLE REFRIGERANT THROTTLING

BACKGROUND OF THE INVENTION

1. Field of the Invention

The present invention relates to a refrigeration circuit for transferring heat energy between two regions. More particularly, the present invention concerns a movable expansion device for use with a reversible refrigeration system, said device having a piston with a metering port and means as set forth herein for adjusting the throttling of refrigerant through that metering port.

2. Description of the Prior Art

In a typical vapor compression refrigeration circuit various components such as a compressor, condenser, evaporator and expansion device are arranged to transfer heat energy between a fluid in heat transfer relation with the evaporator and a fluid in heat transfer relation with the condenser. In a heat pump system, an outdoor coil and an indoor coil are located such that the compressor, through a reversing valve, may direct hot gaseous refrigerant to either coil acting as a condenser. The other coil then acts as an evaporator such that depending upon the position of the reversing valve, heat energy is either rejected or absorbed in both the indoor or the outdoor coil. In the heating mode of operation, heat is rejected in the indoor coil acting as a condenser and heat is absorbed in the outdoor coil acting as an evaporator. The reverse is true in the cooling mode of operation wherein the heat is rejected at the outdoor coil acting as a condenser and heat is absorbed at the indoor coil acting as an evaporator.

Since the operating conditions of a heat pump unit depend upon whether it is in the heating mode of operation or the cooling mode of operation, it is known to utilize an expansion device associated with each mode of operation. The conventional method of accomplishing this was to incorporate two subassemblies each including an expansion device such as thermal expansion valves or distributor and capillaries in parallel with a check valve. Each assembly is associated with a particular heat exchanger such that regardless of the mode of operation the refrigerant flows from the condenser to the evaporator. When the heat exchanger with which the assembly is associated is serving as a condenser, liquid refrigerant flows through the check valve bypassing the expansion device. When the heat exchanger associated with the assembly is acting as an evaporator, the refrigerant may not flow through the check valve but instead is forced to flow through the expansion device into the coil.

A combination device is disclosed in U.S. Pat. No. 3,992,898 issued to the assignee hereof. This patent discloses a piston mounted in a valve body, the piston having a metering port running through the center thereof and fluted channels defining a bypass region between the exterior of the piston and the valve body. This arrangement provides for throttling of the refrigerant through the orifice for expansion purposes when refrigerant flows in one direction and for allowing bypass of the refrigerant around the exterior of the piston as well as through the metering port when refrigerant flows in the other direction such that the free refrigerant flow may be had therethrough. Thus, a single device provides for the expansion of the refrigerant when the coil associated therewith is acting as an evaporator and for allowing free flow of the refrigerant therethrough, similar to the flow through the check valve, when the coil associated therewith is acting as a condenser.

It has further been known to incorporate in refrigeration and air conditioning units where the heat exchangers are sufficiently close in distance a single body having two pistons such that the expansion device associated with each heat exchanger is combined into one device having a piston associated with each heat exchanger.

Utilizing these movable expansion devices as set forth in the patent provides a economical, safe and efficient means for providing the combined operation necessary in a heat pump system. The system may be adjusted as to the amount of refrigerant superheat and other expansion parameters by changing the piston located within the valve body. The piston usually is changed to vary the diameter of the metering port running the length of the piston. Consequently, the pressure drop through the piston when it is serving as an expansion device may be varied. Naturally, to uncouple the expansion device to remove the piston requires that the refrigeration circuit of the system be unsealed and that the necessary steps involved with field repair when the refrigerant circuit is opened be taken. These steps include pumpdown of refrigerant, inserting a filter-drier to remove the unwanted contaminants and posing the risk of contaminants entering the system limiting the design life of the components of the system.

The present invention concerns an improvement of this movable expansion device by providing means for adjusting the diameter of the metering port extending the length of the piston without having to break into the refrigeration circuit of the system and consequently without incurring the potential injuries and side effects to the refrigerant circuit caused by interrupting the integrity thereof. This means for adjusting will further provide the serviceman with a method of fine tuning the operation of the refrigerant circuit without unsealing the circuit.

SUMMARY OF THE INVENTION

It is an object of the present invention to improve refrigeration systems of the type wherein the cycle is thermodynamically reversible to provide heating or cooling.

A further object of the present invention is to provide a simple expansion device which will automatically change its function in response to the direction of refrigerant flow to throttle the refrigerant flowing in one direction and permit an unrestricted movement of refrigerant in an opposite direction.

It is another object of the present invention to provide an expansion device having means to adjust the cross sectional diameter of the metering port flowing therethrough to enable the throttling of the refrigerant to be controlled.

It is a further object of the present invention to provide means for adjusting the throttling of an expansion valve without affecting the integrity of the refrigeration circuit.

It is a yet further object of the present invention to provide a safe, economical and reliable adjustable expansion device.

These and other objects of the present invention are achieved by a refrigeration circuit including an expansion device having a piston slidably contained within the valve body. The piston has a metering port extending the length thereof for throttling refrigerant passing therethrough. The piston additionally has fluid flow channels about the exterior thereof for allowing unrestricted flow of refrigerant in a preselected direction. A screw is mounted in an opening in communication with the metering port such that the screw may be rotated to a position to partially impede the flow of refrigerant through the metering port to thereby adjust the throttling of the refrigerant. A screwdriver portion is mounted to the valve such that the screw and the piston may be engaged to adjust same. A spring arrangement is additionally provided to maintain the screwdriver in a position such that the piston may freely slide in the valve body. A combination of guide and piston extensions act to maintain the orientation of the piston relative to the valve body such that the screwdriver may be aligned with the screw for making the adjustments.

DESCRIPTION OF THE PREFERRED EMBODIMENT

The invention as described herein will refer to a reversible refrigeration circuit utilizing two separate expansion devices. This invention finds applicability with other types of refrigeration circuits or other applications than reversible refrigeration circuits wherein, depending upon the direction of flow, refrigerant can be metered or allowed to flow unrestricted therethrough. It is further to be understood that the present invention finds like applicability to a single valve body having two expansion devices located within the one body.

Figure 1:
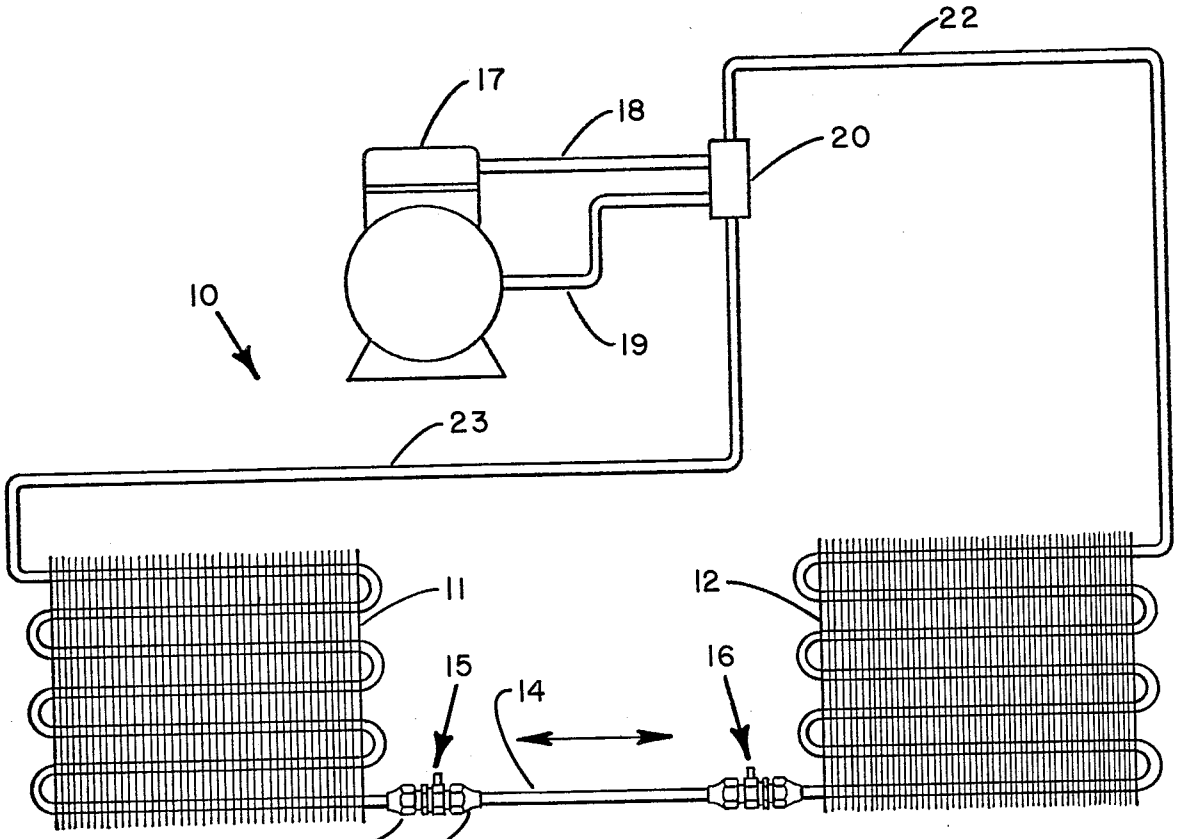
FIG. 1 is a schematic representation of a typical reversible vapor compression refrigeration circuit having an expansion device associated with each heat exchanger.

Referring now to FIG. 1 there can be seen a refrigeration circuit 10 having a compressor 17 connected by compressor suction line 19 and compressor discharge line 18 to reversing valve 20. Reversing valve 20 is connected by line 23 to first heat exchanger 11 and by line 22 to second heat exchanger 12. Expansion devices 15 and 16 are shown adjacent to the heat exchanger they are associated with. Supply line 14 connects expansion device 15 to expansion device 16. As can be seen in reference to expansion device 15, female connectors 31 and 32 are used to secure the expansion device to the supply line and to the tubing extending from the first heat exchanger.

During operation of the heat pump system in the cooling mode, refrigerant is directed from the compressor discharge line 18 to the first heat exchanger which acts as a condenser. Refrigerant is condensed from gas to a liquid therein and flows through expansion device 15. In this mode of operation the piston in expansion device 15 will allow the refrigerant to flow unrestricted therethrough to expansion device 16. The piston expansion device 16 will then meter the refrigerant into the second heat exchanger 12 which serves as an evaporator such that the refrigerant flashes to gas therein absorbing heat energy from the air to be cooled flowing through the heat exchanger. The gaseous refrigerant is then conducted from the second heat exchanger through line 22 through the reversing valve to the compressor suction line 19 leading back to the compressor to complete the circuit.

In the heating mode of operation the reversing valve position is changed such that the gaseous refrigerant is directed into the second heat exchanger wherein it is condensed giving off heat to the area to be heated. Liquid refrigerant from the second heat exchanger then flows through expansion device 16 wherein the piston is positioned such that the flow therethrough is unrestricted and continues on to expansion device 15. The piston of expansion device 15 moves to a position where the refrigerant flow is metered through the metering port and the first heat exchanger acts as an evaporator. Gaseous refrigerant from the first heat exchanger is then returned through line 23 through the reversing valve and back to the compressor to complete the refrigeration circuit in the heating mode of operation.

Figure 2:
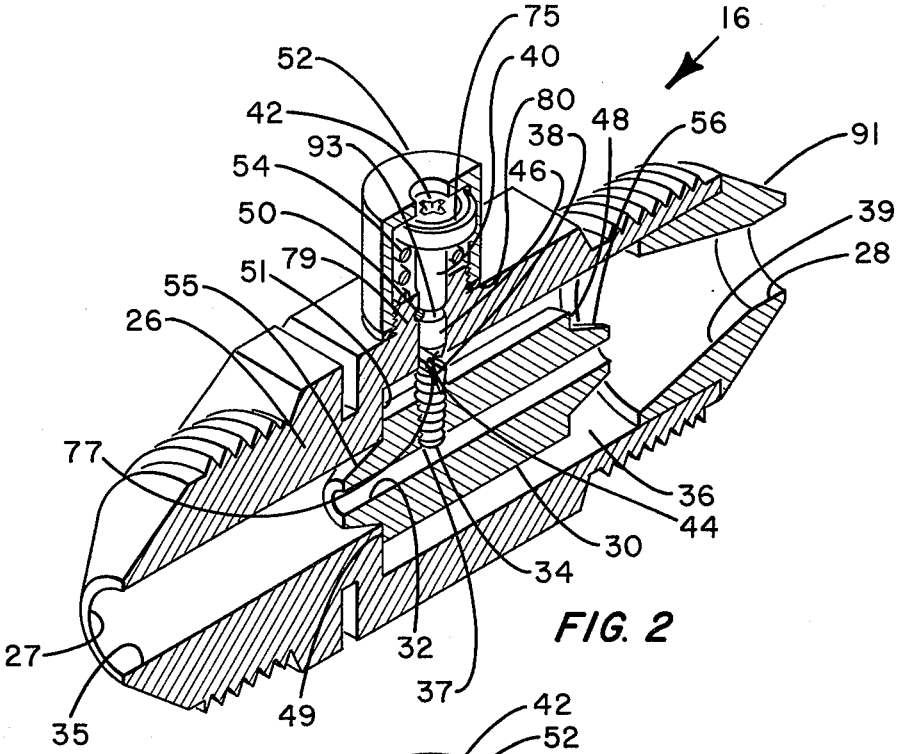
FIG. 2 is a longitudinal sectional view of the piston mounted within the valve body and the screw and screw adjusting means associated therewith.
Figure 3:
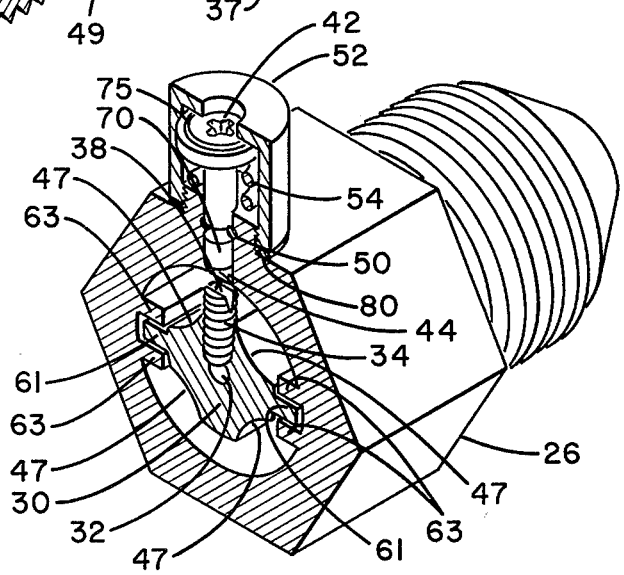
FIG. 3 is another sectional view of the expansion device taken in a plane perpendicular to that of FIG. 2.

Referring now to FIGS. 2 and 3, the specific embodiment of the expansion device including the means for adjusting same are shown. Valve body 26 has piston 30 mounted for sliding motion therein. Valve body 26 has flow passage 35 extending the length thereof from the first opening 27 to second opening 28. In the middle of the valve body having a greater internal diameter than the remainder of the flow passage is annular chamber 36 in which the piston is mounted for sliding movement.

The exterior surface of the valve body is threaded at both ends such that the female connectors as shown in FIG. 1 may be utilized to secure the valve body to associated tubing. Piston 30 has a metering port 32 extending the length thereof. Cone 55 is located on the left hand side of the piston as shown in FIG. 2 and cone 56 is located on the right hand side of the piston as shown in FIG. 2. Additionally, the pistons has on the left hand end thereof flat face 47 and on the right hand end flat face 48. Adjusting screw opening 37 is provided between the metering port and the exterior of the piston. Adjusting screw 34 is shown mounted within the adjusting screw opening. Additionally, the piston has piston extensions 61 extending outwardly therefrom and located between guides 63 formed on the interior surface of the valve body such that when the piston reciprocates within the annular chamber, the guides in combination with the piston extensions serve to maintain the piston aligned in relation to the valve body. Additionally, there can be seen fluted portions forming fluid flow channels 47 about the exterior of the piston.

As shown in FIG. 2, the piston is in the metering position with flat face 49 thereof in contact with end wall 51 of the annular chamber 36 of the valve body such that refrigerant flowing from right to left flows through the metering port and is throttled. When the direction of the flow of refrigerant is in the opposite direction the piston slidably moves to the other end of the chamber until the flat face 48 engages nipple 91 having a tapered internal opening 39. At this point refrigerant may flow from left to right either through the metering port or around the piston through fluid flow channels 47. Consequently, relatively unrestricted refrigerant flow is provided in the left to right direction.

Screwdriver casing 52 is mounted to the exterior surface of valve body 26. As shown in FIGS. 2 and 3, a valve body extension 79 is shown having external threads thereon. Screwdriver casing 52 has internal threads and may be secured to the valve body extension by engagement of the respective screw threads. O-ring 80 is provided between the valve body and the screwdriver casing to maintain a seal therebetween. Screwdriver opening 77 extends through valve body 26. Screwdriver 40 is mounted such that screwdriver blade 44 extends through the opening and O-ring 50 is mounted in O-ring opening 48 within the screwdriver opening to provide a seal between the screwdriver shaft and the opening. Screwdriver head 42 extends upwardly into screwdriver casing 52 and has O-ring 75 mounted in the head thereof to form a seal between the screwdriver head and the top of the screwdriver casing. Spring 54 is mounted between the valve body and the screwdriver head to bias the screwdriver upwardly to both maintain the screwdriver blade such that the screw is not engaged by the blade to allow for free motion of the piston when it is not being adjusted and such that O-ring 75 is utilized with the bottom surface of the top of the screwdriver casing 52 to provide an additional seal for preventing refrigerant from exiting the valve body. When it is desirable to adjust the throttling, the screwdriver is depressed against the spring such that the screwdriver blade may engage screw slot 38 of the adjusting screw for rotation of same. A small opening is provided at the top of the screwdriver casing for engagement of screwdriver head 42 with an operator supplied external screwdriver for rotation of the affixed screwdriver and the adjusting screw.

Three different seals are shown to assure that there is no refrigerant leakage from within the valve body through the screwdriver casing. The casing itself is sealed to the valve body by O-ring 80, the screwdriver shaft is sealed within the screwdriver opening by O-ring 50 and the top of the screwdriver is sealed to the screwdriver casing with O-ring 75. This combination should prevent any substantial refrigerant flow from the valve body.

During adjustment of the refrigeration circuit the repairman will set the unit for a predetermined mode such that the piston will move to one end of the annular chamber. In that position the adjusting screw will be aligned with the screwdriver since the piston extensions and guides prevent the piston from rotation and since refrigerant flow has forced the piston to abut against the interior surface of the valve body. The repairman then inserts his portable screwdriver into the screwdriver head and manually depresses the screwdriver head until the screwdriver blade engages the screw slot of the adjusting screw. The repairman then, while maintaining the screwdriver depressed, rotates the screwdriver in one direction if he desires to further impede the flow of refrigerant through the metering port or in the other direction if he desires to increase the cross sectional flow area of the metering port at the adjusting screw. When the repairman has adjusted the screw to the proper position he withdraws his portable screwdriver allowing the built-in screwdriver to be biased upwardly by the spring disengaging the screwdriver blade from the adjusting screw and allowing the piston to freely reciprocate within the annular chamber. Consequently, it is possible for the repairman to adjust the throttling of the refrigerant without affecting the integrity of the refrigeration circuit.

While the invention has been described in reference to the preferred embodiment it should be understood by those skilled in the art that modifications and variations can be effected within the spirit and the scope of the invention.

I claim:

1. An expansion device for passing a flow of refrigerant in one direction and throttling the flow of refrigerant in the opposite direction which comprises:

a body having a flow passage therethrough for passing a flow of refrigerant in either direction, said flow passage including an expanded chamber formed in said body;

a piston slidably mounted within said chamber for movement between a first position and a second position in response to the direction of refrigerant flow through said chamber, said piston having a metering port passing therethrough for throttling refrigerant when said piston is in the first position and at least one flow channel in parallel with the metering port for passing a flow of refrigerant when said piston is in the second position; and means for adjusting the volume flow of refrigerant through the metering port to regulate the throttling of refrigerant when the piston is in the first position.

2. The apparatus as set forth in claim 1 wherein the means for adjusting comprises:

the piston defining a threaded opening in communication with the metering port and a screw threadably engaged in said opening, said screw acting to modify the cross sectional area of the metering port to thereby regulate the throttling of the refrigerant flowing therethrough.

3. The apparatus as set forth in claim 2 and further including a screw rotation means mounted in a screwdriver casing affixed to the body of the expansion device, said screw rotation means having a blade which may engage the screw for effecting rotation thereof.

4. The apparatus as set forth in claim 3 and further comprising a spring mounted within the screwdriver casing to bias the screw rotation means away from the piston, whereby during normal operation the piston may reciprocate within the expanded chamber without the screw contacting the screw rotation means and the screw rotation means may be forced inwardly against the spring to engage the screw when rotation of the screw is desired.

5. The apparatus as set forth in claim 2 wherein the body has guide means extending within the expanded chamber and the piston has piston extensions which coact with the guide means to maintain the piston in a predetermined orientation to maintain the screw at a desired location.

6. A reversible refrigeration system comprising:

a compressor having a suction line and a discharge line;

a first heat exchanger;

a second heat exchanger;

reversing means for alternately connecting the suction line and discharge line of the compressor to the first heat exchanger and the second heat exchanger;

a supply line for connecting the first heat exchanger to the second heat exchanger;

at least one expansion device mounted in the supply line between the first heat exchanger and the second heat exchanger, said expansion device having an elongated body coaxially aligned with the conduit and having a central flow passage through said body, said flow passage including an expanded chamber;

a piston slidably mounted within the chamber having a flow metering port extending therethrough for throttling refrigerant and at least one channel in parallel with the flow metering port for passing refrigerant through the body without passing through the metering port, said piston being arranged to move to a first position when refrigerant is throttled through the metering port and to a second position wherein refrigerant may bypass the metering port; and adjusting means for varying the cross sectional area of at least a portion of the metering port for regulating the amount of throttling of refrigerant when the piston is in the first position.

7. The apparatus as set forth in claim 6 wherein the adjusting means comprises:

the piston defining an opening in communication with the metering port;

a screw mounted in the opening, said screw having a throttling end which may be moved into the metering port for restricting flow area therethrough and a driving end through which rotational force may be transmitted to the screw.

8. The apparatus as set forth in claim 7 and further including:

an opening through the body;

a screwdriver extending through the opening, said screwdriver having a blade end adapted to engage the driving end of the screw;

a spring for biasing the screwdriver away from the screw; and first sealing means for preventing refrigerant flow from the flow passage out the opening in the body, said spring acting to disengage the screwdriver from the screw allowing for free sliding motion of the piston and upon said spring being depressed the screwdriver then engaging the screw.

9. The apparatus as set forth in claim 8 and further including:

a screwdriver casing mounted to the body to secure the screwdriver therein; and second sealing means preventing refrigerant flow from the flow passage out the screwdriver casing.

10. The apparatus as set forth in claim 7 wherein the body guide extending within the expanded chamber and the piston has piston extensions which coact with the guide means to maintain the piston in a predetermined orientation to maintain the screw in a desired location.

* * * * *